US012421662B2

(12) United States Patent
Jonsson

(10) Patent No.: US 12,421,662 B2
(45) Date of Patent: Sep. 23, 2025

(54) YANKEE DRYING CYLINDER AND A TISSUE PAPER MAKING MACHINE

(71) Applicant: VALMET AKTIEBOLAG, Sundsvall (SE)

(72) Inventor: Ola Jonsson, Hammarö (SE)

(73) Assignee: VALMET AB, Sundsvall (SE)

( * ) Notice: Subject to any disclaimer, the term of this patent is extended or adjusted under 35 U.S.C. 154(b) by 224 days.

(21) Appl. No.: 18/044,472

(22) PCT Filed: Oct. 20, 2021

(86) PCT No.: PCT/EP2021/079114
§ 371 (c)(1),
(2) Date: Mar. 8, 2023

(87) PCT Pub. No.: WO2022/084403
PCT Pub. Date: Apr. 28, 2022

(65) Prior Publication Data

US 2024/0011222 A1 Jan. 11, 2024

(30) Foreign Application Priority Data

Oct. 21, 2020 (AT) ..... A 50207/2020
Oct. 21, 2020 (DE) ..... 202020106010.4
Oct. 21, 2020 (IT) ..... 202020000005881

(51) Int. Cl.
*D21F 5/18* (2006.01)
*C22C 38/00* (2006.01)
(Continued)

(52) U.S. Cl.
CPC ..... *D21F 5/181* (2013.01); *C22C 38/001* (2013.01); *C22C 38/002* (2013.01); *C22C 38/02* (2013.01);
(Continued)

(58) Field of Classification Search
CPC ..... C22C 38/001; C22C 38/002; C22C 38/02; C22C 38/04; C22C 38/06; C22C 38/42;
(Continued)

(56) References Cited

U.S. PATENT DOCUMENTS 4,064,608 A 12/1977 Jaeger
4,139,410 A 2/1979 Tapio et al.
(Continued)

FOREIGN PATENT DOCUMENTS

AT 519996 A2 12/2018
DE 212017000093 U1 * 12/2018 ..... D21F 5/021
(Continued)

OTHER PUBLICATIONS

English translation of DE212017000093U1 retrieved from Espacenet on Jan. 22, 2025 (Year: 2025).*
(Continued)

*Primary Examiner* — Abbas Rashid
*Assistant Examiner* — Elisa H Vera
(74) *Attorney, Agent, or Firm* — Alston & Bird LLP

(57) ABSTRACT

The invention relates to steel Yankee cylinders for tissue-making machines and tissue-making machines using such steel Yankee cylinders wherein the outer surface (9) of the cylindrical shell of the steel Yankee cylinder is formed by a steel of the grade P690 as defined in European Standard EN 10028-6:2017 or a similar steel.

15 Claims, 5 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***D21F 5/02*** | (2006.01) |
| ***D21G 3/00*** | (2006.01) |
| ***D21H 23/56*** | (2006.01) |

(52) U.S. Cl.
CPC ..... *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *D21F 5/021* (2013.01); *D21G 3/005* (2013.01); *D21H 23/56* (2013.01)

(58) Field of Classification Search
CPC ..... C22C 38/44; C22C 38/46; C22C 38/48; C22C 38/50; C22C 38/54; C22C 38/58; C22C 38/22; C22C 38/24; C22C 38/26; C22C 38/32; D21F 5/021; D21F 5/181; D21G 3/005; D21H 23/56; F26B 13/14; F26B 13/18
See application file for complete search history.

(56) References Cited

U.S. PATENT DOCUMENTS

| | | | | |
|---|---|---|---|---|
| 5,090,135 | A | 2/1992 | Wolf et al. | |
| 5,123,152 | A | 6/1992 | Tenkula et al. | |
| 5,853,539 | A | 12/1998 | Smith et al. | |
| 6,171,657 | B1 | 1/2001 | Perdikaris | |
| 6,689,250 | B1 | 2/2004 | Luu et al. | |
| 7,527,708 | B2 | 5/2009 | Gustavsson | |
| 9,885,153 | B2 | 2/2018 | Meitner et al. | |
| 10,240,291 | B2 | 3/2019 | Etschmaier | |
| 2015/0240420 | A1* | 8/2015 | Cederloef | D21F 5/181 162/289 |
| 2016/0160443 | A1* | 6/2016 | Duhen | D21H 27/004 428/514 |
| 2020/0199697 | A1 | 6/2020 | Ghanimi et al. | |

FOREIGN PATENT DOCUMENTS

| | | | |
|---|---|---|---|
| EP | 2085513 | B1 | 9/2011 |
| EP | 2126203 | B1 | 6/2012 |
| EP | 2475819 | B1 | 6/2014 |
| EP | 2614182 | B1 | 5/2015 |
| EP | 2920360 | B1 | 2/2017 |
| EP | 2963176 | B1 | 3/2017 |
| EP | 3225710 | A1 | 10/2017 |
| WO | WO-2016/026662 | A1 | 2/2016 |

OTHER PUBLICATIONS steelnumber.com, European Steel and Alloy Grades P690Q, Jul. 23, 2014, url:https://web.archive.org/web/20140723002603/https://www.steelnumber.com/en/steel_composition_eu.php?name_id=490 (Year: 2014).*

International Search Report and Written Opinion for International Application No. PCT/EP2021/079114, dated Feb. 1, 2022, (12 pages), European Patent Office, Rijswijk, Netherlands.

Bauböck, Jörg. "Application of a Steel Yankee in Tissue Machines," TAPPI Yankee Dryer Safety Committee, Jacksonville Oct. 23, 2007, (22 pages).

* cited by examiner

YANKEE DRYING CYLINDER AND A TISSUE PAPER MAKING MACHINE

FIELD OF THE INVENTION

The present invention relates to a steel Yankee drying cylinder and a machine for making tissue paper comprising such a Yankee drying cylinder.

BACKGROUND OF THE INVENTION

A machine for making tissue paper typically includes a Yankee drying cylinder which, during operation, is heated internally by hot steam. In the following, the term "Yankee" will be used for Yankee drying cylinders. A wet fibrous web that is transferred to the Yankee is dried on the outer surface, the "drying surface" of the Yankee, and subsequently creped from the drying surface (the outer surface) of the Yankee by a creping doctor. During the twentieth century, Yankees were usually made of cast iron but in recent years, Yankees have been made in welded steel. A steel Yankee weighs less than a cast iron Yankee having the same required strength and steel Yankees are thus seen as advantageous. An example of a steel Yankee is disclosed in EP 2126203 B1. As mentioned above, a creping doctor is used to crepe the ready-dried fibrous web from the surface of the Yankee. In practice, this means that the surface of the Yankee will be subjected to pressure from the doctor blade. A cast Yankee has a surface with a relatively high hardness since cast iron may typically have an HB hardness (i.e. Brinell hardness) of 220-260. For this reason, the surface is not so easily worn out by contact with the doctor blade that is pressed against its surface. However, experience has showed that even Yankees made of cast iron are subjected to a considerable degree of wear. For this reason, it has long been a practice to metallize the surface of Yankees in order to obtain a harder surface. In the context of this patent application, the terms "to metallize" and "metallization" refer to a process in which the outer surface (the drying surface) of the Yankee is coated with a hard layer which may be based on an element or an alloy or a mixture of metal powder and at least one carbide or nitride or possibly other elements, or a metal matrix containing at least one carbide or nitride or possibly other elements. The coating may typically be applied to the surface of the Yankee by spraying. An example of this technology is disclosed in U.S. Pat. No. 4,064,608. Other examples are disclosed in U.S. Pat. Nos. 5,123,152; 6,171,657 and 10,240,291. It should be noted that many different compositions for the hard layer have been proposed. For example, the hard layer may be an iron alloy containing from about 20 to about 47 weight percent chromium, about 2.5 to about 6.5 weight percent boron, about 1.7 to about 2.7 weight percent silicon, and less than about 8 weight percent molybdenum as suggested in the above-mentioned U.S. Pat. No. 6,171,657. In the context of Yankees, it should be noted that the term "coating" may also be used to refer to liquid coating that is continuously sprayed onto the surface of the Yankee during operation which is fundamentally different from the hard coating that is applied as a part of the manufacturing process. When discussing application of a hard layer in order to increase hardness and resistance to wear, a technical term often used by persons skilled in the art is "metallization" and this term and "to metallize" (except when used in reference to other documents that are cited herein and that use the term in a different meaning) will be used in this patent application and all patents that may be granted based on it to refer to the application of a hard and wear-resistant layer permanently joined to the steel drying surface of the Yankee, regardless of the exact composition of that layer. Such a layer will be called "metallization layer" in the following. The term "coating" as used henceforth in this patent application will refer to the application of a temporary liquid coating during operation of a tissue paper making machine (except when used in reference to other documents that are cited herein and that use the term in a different meaning).

Steel used for making steel Yankees has a hardness which is markedly lower than that of cast iron. A typical value for the hardness of such steel may be on the order of about 140 HB or, possibly, in the range of 120-170 HB.

Since steel grades used for Yankee drying cylinders typically have a hardness (on the order of 140 HB) that is substantially lower than that of cast iron (220-260 HB), it has been a requirement that Yankees made of steel be metallized. Different metallization layers for steel Yankees have been proposed. In a paper from 2007, Mr. Jörg Bauböck discussed a steel Yankee with a "metallic coating" with a surface hardness which was said to be double that of cast iron ("Application of a Steel Yankee in Tissue Machines", TAPPI Yankee Dryer Safety Committee, Jacksonville 10/23/07) although no details were given about the exact composition. In a 2008 paper by Mr. Luca Mignani ("Advances with Steel Yankee Dryers", TISSUE WORLD, Asia 2008), Mr. Mignani suggested that a steel Yankee dryer can be provided with a "metal coating" (i.e. metallization layer) and that the "metal coating" may be for example an alloy with a high content of Cr and Ni and have a hardness of 60 HRC. Although hardness measured according to HRC does not correspond directly to Brinell hardness, the value of 60 HRC can be said to correspond to about 600 HB. In the same paper, Mr. Mignani also suggests that INFINIKOTE® can be used. Infinikote® is a trade mark owned by Valmet Corporation and refers to metallization of Yankees with a thermal sprayed metal coating. The paper by Mr. Mignani gives the hardness value in this case as "50 to 60 HRC", i.e. on the order of about 500-600 HB.

As an alternative to metallization, it has been suggested that the shell of a steel Yankee be hardened by laser and such a solution is disclosed in AT 519996 A2. According to that document, it is possible to obtain a hardness value of up to 400 HB.

However, both currently known technologies for metallization and possible hardening by laser represent a further step in the manufacturing process of a Yankee which makes the manufacturing process more complicated.

With regard to metallized steel Yankees, the inventors of the present invention have also noted that streaks can occur in the paper that has been dried on such dryers.

The inventors have also seen that the metallization layer of a Yankee may crack and/or delaminate which makes it necessary to halt production and shut off the machine. When this occurs, production is seriously disturbed and the costs for this may be very high.

Therefore, it is an object of the present invention to provide a steel Yankee that is properly protected against surface wear and which can yet be manufactured in a simple way and to provide a machine having such a steel Yankee. A further object of the invention is to provide a steel Yankee that prevents or reduces the occurrence of streaks in the paper that is dried on the machine.

BRIEF SUMMARY OF THE INVENTION

The invention relates to a steel Yankee drying cylinder comprising a cylindrical shell having two axial ends. An end wall is joined to each axial end by means of a circumferential weld bead. The cylindrical shell further has an outer surface and an inner surface in which inner surface circumferential grooves are formed. According to an embodiment of the invention, the cylindrical shell is entirely made of steel of the family of P690 steels as defined in European Standard EN 10028-6:2017 or a similar steel and, thus, the outer surface of the shell is formed by such steel i.e. steel of a grade of P690 steels or a similar steel having the composition defined in claim 1. In another embodiment of the invention, a cylindrical shell is made of a different grade of steel and an outer layer made of a P690 grade steel or a similar steel is applied to the exterior cylindrical surface of the cylindrical shell.

The invention also relates to a tissue paper making machine comprising the inventive steel Yankee drying cylinder and a creping doctor with a creping blade which is arranged to act against the outer surface of the Yankee drying cylinder.

In embodiments of the invention, the tissue paper making machine further comprises a device for applying liquid coating onto the outer surface of the Yankee drying cylinder.

The paper making machine may optionally also comprise a Yankee drying hood that is arranged to be capable of blowing hot air against the outer surface of the cylindrical shell over a part of the circumference of the shell.

In embodiments of the invention, a cleaning doctor may be arranged to act against the outer surface of the shell at a location which, in the direction of rotation of the Yankee, is located after the creping doctor but before the coating device.

According to a first embodiment, the machine may additionally comprise at least one through-air drying cylinder. In this embodiment, the imprinting fabric will be an air permeable fabric which is arranged to carry a fibrous web over a part of the circumference of the at least one through-air drying cylinder and to carry the fibrous web from the at least one through-air drying cylinder to the transfer nip formed between the press roll and the Yankee.

DETAILED DESCRIPTION OF THE INVENTION

Figure 1:
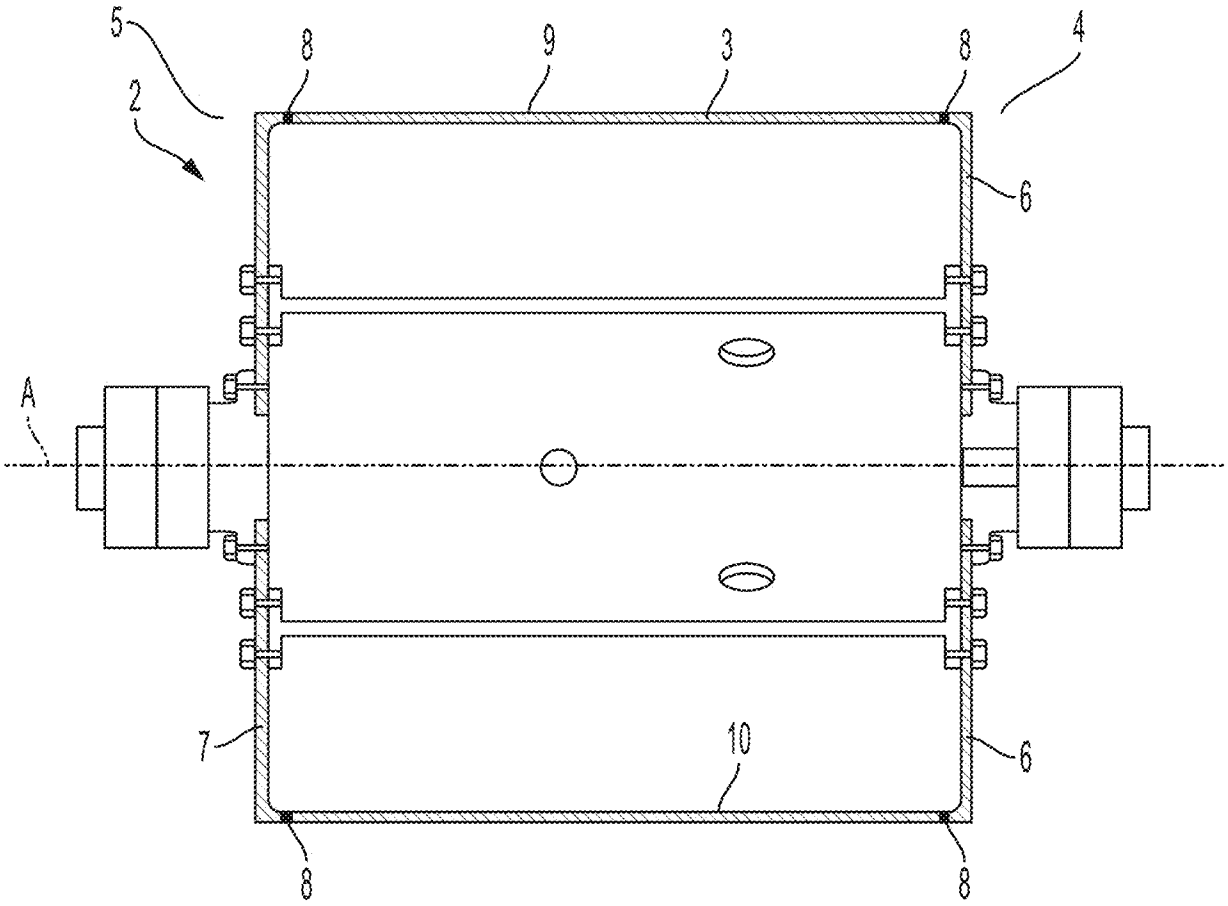
FIG. 1 is a schematic cross-sectional representation of a Yankee.
Figure 2:
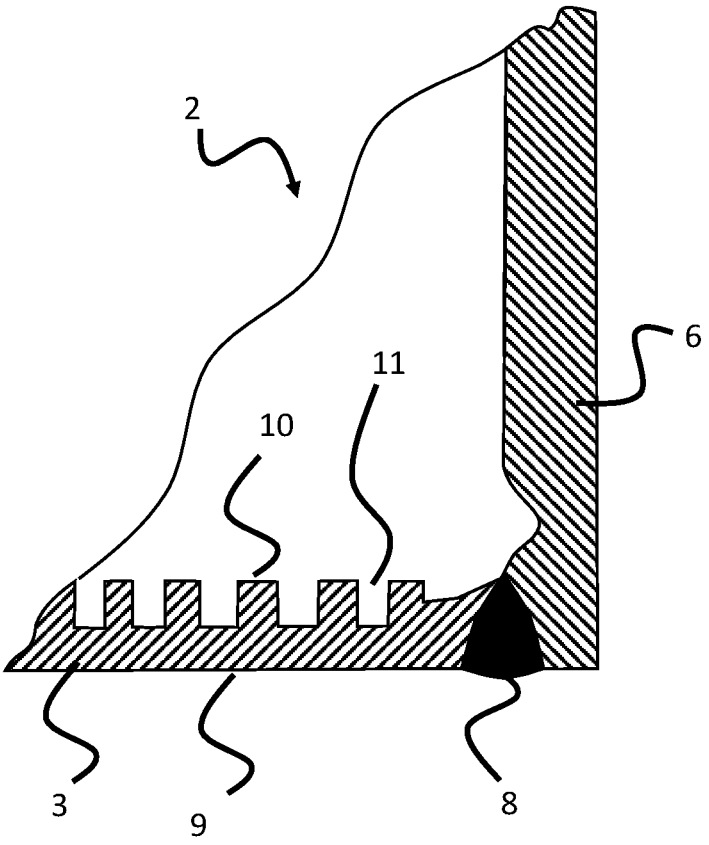
FIG. 2 is an enlargement of a part of FIG. 1

With reference to FIG. 1, the Yankee drying cylinder 2 of the present invention is a steel Yankee drying cylinder that comprises a cylindrical shell 3 having two axial ends 4, 5. It should be understood that the cylindrical shell 3 is a circular cylindrical shell. An end wall 6, 7 is joined to each axial end 4, 5 by means of at least one circumferential weld bead 8. A single weld bead may be applied from inside the shell or, more preferably, from outside the shell. If two weld beads are used then a first weld bead may be applied from outside the shell and a second weld bead applied from inside the shell or, as an alternative, a first weld bead may be applied from inside the shell and a second weld bead applied from outside the shell. The shell can be joined to the end walls in, for example, the way disclosed in EP 2920360 B1 or in EP 2126203 B1. The end walls may optionally be provided with thermal insulation, for example as disclosed in EP 2475819 B1 or in WO 2016/026662 A1. As can be seen in FIG. 2, the cylindrical shell 3 has an outer surface 9 and an inner surface 10. With further reference to FIG. 2, preferably circumferential grooves 11 are formed in the inner surface 10 of the cylindrical shell 3. In the groves 11, condensate water will be accumulated during operation and the Yankee drying cylinder 2 is preferably provided with means for evacuating condensate water from the grooves 11, for example as disclosed in U.S. Pat. No. 5,090,135 or in EP 2614182 B1.

Figure 3:
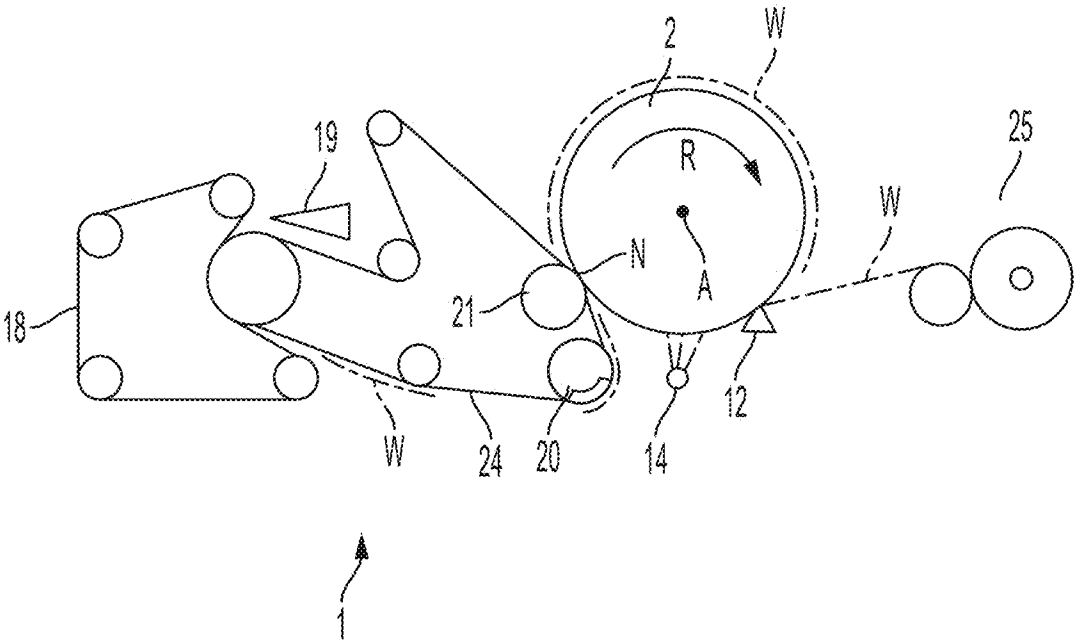
FIG. 3 is a schematic side view of the inventive tissue making machine during operation.

With further reference to FIG. 3, the inventive Yankee drying cylinder 2 is used in a tissue paper making machine 1. When the Yankee drying cylinder is used in the machine 1, a creping doctor 12 is used. The creping doctor 12 has a creping blade 13 that is arranged to act against the outer surface 9 of the shell 3 of the Yankee drying cylinder 2. In FIG. 3, the Yankee drying cylinder is represented as rotating about its axis of rotation A in the direction of arrow R, i.e. "clockwise" in FIG. 3. As can be understood from FIG. 3, the shell has a circular cylindrical shape. The Yankee drying cylinder is so arranged in the tissue paper making machine that it is rotatable about the axis of rotation A.

As can be seen in FIG. 3, a fibrous web W (shown schematically and incompletely with dashed and solid lines) is formed in a forming section 17 between a forming fabric 18 and a fabric 24 which may be a water-absorbing felt. The fibrous web W is formed from stock injected from a head box 19. The newly formed fibrous web W is carried on the felt 24 to a nip N between a press roll 21 and the Yankee drying cylinder 2. The press roll 21 that is used in the nip against the Yankee may conceivably be, for example, a shoe roll with a design as disclosed in U.S. Pat. Nos. 7,527,708; 9,885,153 or EP 2085513 B1 but other rolls than a shoe roll may also be considered. The wet fibrous web W may be subjected to a degree of dewatering in the nip N which then serves as a dewatering press nip. The nip N could also be essentially just a transfer nip in which no substantial dewatering occurs. The nip N may optionally be preceded by a suction turning roll 20. The fibrous web W is transferred onto the heated outer surface 9 of the cylindrical shell 3 of the Yankee drying cylinder 2 and the fibrous web W is then dried by heat that comes from hot steam that is supplied into the Yankee drying cylinder 3. The dried fibrous web W is then creped off from the Yankee drying cylinder by the doctor 12 and sent to a reel-up 25.

During operation, the tissue paper making machine may be running at a speed which is in the range of 1200 m/min-2000 m/min. However, higher speeds may also be considered and machine speeds in the range of 2000 m/min-2300 m/min may also be used or possibly even speeds up to 2400 m/min. In all embodiments of the invention, the Yankee may have a diameter in the range of, for example, 2 m—to greater than 7 m. Some diameters are more common than others, for example 3.5 m; 3.66 m; 4.88 m or 5.5 m. The width of the Yankee 2 may be, for example, in the range of 0.6 m for pilot machines to greater than 7 m. For example, the width could be 3 m or 5 m. However, the Yankee could also have other dimensions than the ones given above.

Figure 4:
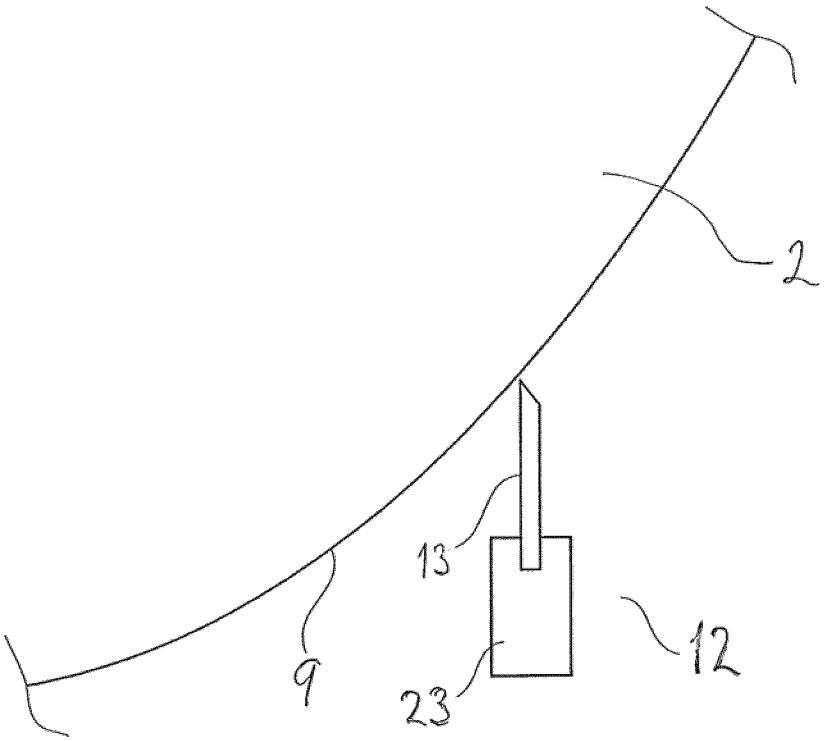
FIG. 4 is a schematic representation of the creping doctor acting against the Yankee drying cylinder.

With reference to FIG. 4, the doctor 12 preferably includes a blade holder 23 that holds the creping lade 13. During operation, the creping blade 13 will act against the outer surface 9 of the shell 3 to crepe a dried fibrous web from the outer surface 9.

Figure 5:
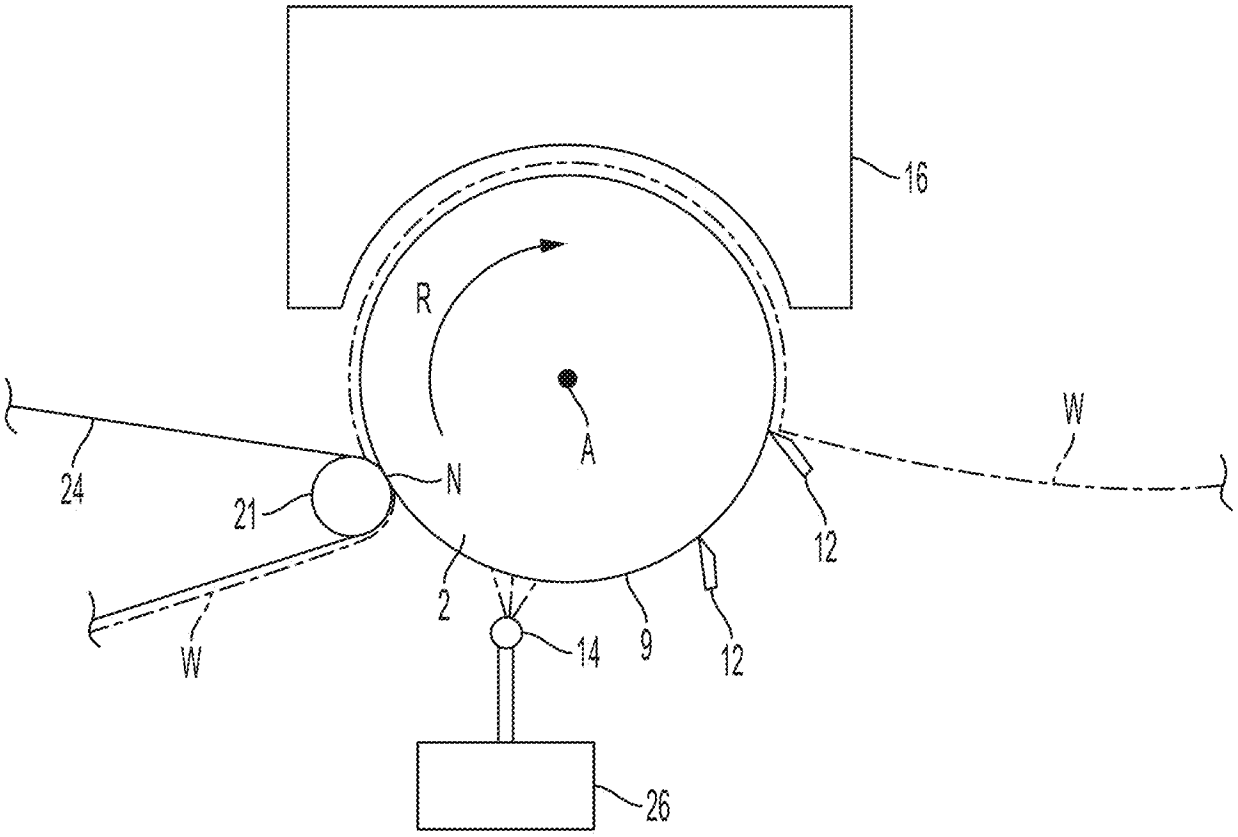
FIG. 5 is a schematic side view showing how the tissue making machine may have a Yankee drying hood.

With reference to FIG. 5, the tissue paper making machine may be provided with a Yankee drying hood 16 that is arranged to be capable of blowing hot air against the outer surface 10 of the cylindrical shell 3 over a part of the circumference of the cylindrical shell 3. The Yankee drying hood may be, for example, such a Yankee drying hood as is disclosed in EP 2963176 B1 but other Yankee drying hoods may also be considered and the inventive machine may also operate without a Yankee drying hood. A further doctor 12' is indicated in FIG. 5. This further doctor is optional and may be a cleaning doctor for scraping off fiber residue from the Yankee drying cylinder.

The tissue paper making machine preferably also comprises a device 14 for applying liquid coating onto the outer surface 9 of the Yankee drying cylinder 2. The liquid coating typically comprises polyvinyl alcohol and other chemical agents. Coating that is applied may comprise, for example, 50-65% by weight polyvinyl alcohol (PVOH), an adhesive that constitutes 15-30% by weight of the coating, a modifier/release agent that constitutes 5-30% by weight of the coating and preferably also phosphate. Phosphate used for such coating may be, for example, mono-ammonium phosphate, Di-ammonium phosphate, trisodium phosphate or tetra phosphate. Instead of the above-mentioned phosphates (or in combination with one or several of them), phosphoric acid may be used in the coating. A supply system for supplying liquid coating is symbolically indicated by the reference numeral 26.

During operation, the creping doctor 12 may act against the outer surface 9 of the cylindrical shell 3 with a linear load which may, in some cases, be as high as 10 kN/m. This means that the cylindrical shell 3 is subjected to wear. For Yankee drying cylinders made of steel, this can be a very serious problem and it has been the standard procedure to give them a protective layer, a so called "metallization layer" of a hard material that is resistant to coating. However, cracks may occur in such hard layers that can quickly lead to delamination of the entire layer such that operation of the machine must be interrupted. Moreover, the doctor blade can be damaged by cracks and delamination. When a crack catches the doctor blade, the doctor blade can be deformed, and this may be a source of streaks in the paper. Therefore, elimination of the metallization layer is actually desirable from a process point of view.

The inventor of the present invention has now found that it is possible to entirely avoid the use of a hard metallization layer by using a steel of the steel grade P690 or a similar steel with a composition and properties as described in the following for making the cylindrical shell 3 such that the outer surface of the shell 3 is formed by a steel of the grade P690 or a similar steel. In a first embodiment of the invention the cylindrical shell is formed of a P690 grade steel or a similar steel. In a second embodiment of the invention the cylindrical shell is formed of inner cylindrical shell made of steel and is covered with a continuous outer layer of a P690 grade steel or a similar steel. This continuous outer layer of P690 grade steel or similar can be formed of annular or spiral strips of P690 grade steel or a similar steel which are welded, for example by their edges and/or by through holes bored through the strips. to the underlying steel shell. Alternatively the continuous outer layer of P690 grade steel or a similar steel can be formed of a plurality of plates of a P690 grade steel or a similar steel, the plates being welded to the inner cylindrical shell by their edges and/or through holes bored through the plates.

The hardness of the P690 grade steel or similar steel outer surface preferably is equal to or greater than 770 MPa and equal to or less than 940 MPa.

In each embodiment, the surface against which the doctor blade 13 acts will this be formed by steel of the steel grade P690 or a similar steel. This is possible without laser hardening as suggested in AT 519996 A2. The steel grade P690 has been found to be so resistant to wear that it does not need any metallization layer and similar steels will have the same wear resistance. Moreover, it has such properties with regard to welding, strength and heat transfer that are required for a Yankee drying cylinder.

Steel of a grade of P690 steels or a similar steel for use in the present invention has the following composition in weight percent:

- C equal to or greater than 0.12% and equal to or less than 0.20%
- Si equal to or greater than 0.10% and equal to or less than 0.80%
- Mn equal to or greater than 1.00% and equal to or less than 1.70%
- Cr equal to or greater than 0.10% and equal to or less than 1.50%
- Mo equal to or greater than 0.30% and equal to or less than 0.70%
- V equal to or greater than 0.005% and equal to or less than 0.12%
- Nb equal to or greater than 0.005% and equal to or less than 0.060%
- B equal to or greater than 0.0006% and equal to or less than 0.005%
- P equal to or less than 0.025%
- S equal to or less than 0.010%
- N equal to or less than 0.015%
- Cu equal to or less than 0.30%
- Ni equal to or less than 2.50%
- Ti equal to or less than 0.05%
- Zr equal to or less than 0.15%
- Al equal to or less 0.01%
- Remainder iron and impurities.

Preferably, in a steel of grade P690 or a similar steel the percentage by weigh of Nb, Ti, V, Zr is equal to or greater than 0.015%.

Optionally, if there is aluminium present then the sum of V, Ti, Nb, and Al is equal to or greater than 0.02%

Preferably for products made of a P690 grade steel or a similar steel which have a maximum thickness which is equal to or less than 50 mm thick the upper yield strength (ReH) measured by ISO 6892-1:2019 of the P690 is equal to or greater than 690 MPa and the corresponding tensile strength measured by ISO 6892-1:2019 preferably is equal to or greater than 770 MPa and equal to or less than 940 MPa.

Preferably for products made of a P690 grade steel which are greater than 50 mm thick and equal to or less than 100 mm thick the yield strength measured by ISO 6892-1:2019 of the P690 is equal to or greater than 670 MPa and the corresponding tensile strength measured by ISO 6892-1:2019 preferably is equal to or greater than 770 MPa and equal to or less than 940 MPa.

Preferably for products made of a P690 grade steel which are greater than 100 mm thick the yield strength measured by ISO 6892-1:2019 of the P690 is equal to or greater than 630 MPa and the corresponding tensile strength measured by ISO 6892-1:2019 preferably is equal to or greater than 770 MPa and equal to or less than 940 MPa.

Thanks to the invention, the risk that the machine must be shut down because of damage to the drying surface of the Yankee is significantly reduced.

The invention claimed is:

1. A steel Yankee drying cylinder (2) comprising:

a cylindrical shell (3) having two axial ends (4, 5), and an end wall (6, 7) being joined to each axial end (4, 5) by means of a circumferential weld bead (8), the cylindrical shell (3) further having an outer surface (9) and an inner surface (10), wherein the outer surface (9) of the cylindrical shell (3) is made of a steel having the following composition by weight:

C equal to or greater than 0.12% and equal to or less than 0.20%

Si equal to or greater than 0.10% and equal to or less than 0.80%

Mn equal to or greater than 1.00% and equal to or less than 1.70%

Cr equal to or greater than 0.10% and equal to or less than 1.50%

Mo equal to or greater than 0.30% and equal to or less than 0.70%

V equal to or greater than 0.005% and equal to or less than 0.12%

Nb equal to or greater than 0.005% and equal to or less than 0.060%

B equal to or greater than 0.0006% and equal to or less than 0.005%

P equal to or less than 0.025%

S equal to or less than 0.010%

N equal to or less than 0.015%

Cu equal to or less than 0.30%

Ni equal to or less than 2.50%

Ti equal to or less than 0.05%

Zr equal to or less than 0.15%

Al equal to or less than 0.01%

Remainder iron and impurities.

2. The steel Yankee drying cylinder according to claim 1, wherein the cylindrical shell (3) is made of a steel having the following composition by weight:

C equal to or greater than 0.12% and equal to or less than 0.20%

Si equal to or greater than 0.10% and equal to or less than 0.80%

Mn equal to or greater than 1.00% and equal to or less than 1.70%

Cr equal to or greater than 0.10% and equal to or less than 1.50%

Mo equal to or greater than 0.30% and equal to or less than 0.70%

V equal to or greater than 0.005% and equal to or less than 0.12%

Nb equal to or greater than 0.005% and equal to or less than 0.060%

B equal to or greater than 0.0006% and equal to or less than 0.005%

P equal to or less than 0.025%

S equal to or less than 0.010%

N equal to or less than 0.015%

Cu equal to or less than 0.30%

Ni equal to or less than 2.50%

Ti equal to or less than 0.05%

Zr equal to or less than 0.15%

Al equal to or less than 0.01%

Remainder iron and impurities.

3. The steel Yankee drying cylinder according to claim 1, wherein the sum of the percentages by weight of Nb, Ti, V, Zr in the steel is equal to or greater than 0.015%.

4. The steel Yankee drying cylinder according to claim 1, wherein the sum of the percentages by weight of V, Ti, Nb, and Al in the steel is equal to or greater than 0.02%.

5. A tissue paper making machine (1) comprising:

the steel Yankee drying cylinder (2) according to claim 1, and a creping doctor (12) with a creping blade (13) which is arranged to act against the outer surface (9) of the Yankee drying cylinder (2).

6. The tissue paper making machine (1) according to claim 5, wherein the machine (1) further comprises a device (14) for applying liquid coating onto the outer surface (9) of the Yankee drying cylinder (2).

7. The tissue paper making machine (1) according to claim 5, wherein the machine further comprises a Yankee drying hood (16) that is arranged to be capable of blowing hot air against the outer surface (9) of the cylindrical shell (3) over a part of the circumference of the cylindrical shell (3).

8. The tissue paper making machine (1) according to claim 5, wherein the upper yield strength (ReH) measured by ISO 6892-1:2019 of the steel is equal to or greater than 690 MPa and the corresponding tensile strength measured by ISO 6892-1:2019 is equal to or greater than 770 MPa and equal to or less than 940 MPa.

9. A cylindrical shell (3) for a Yankee cylinder that comprises an outer surface (9) made of a steel having the following composition by weight:

C equal to or greater than 0.12% and equal to or less than 0.20%

Si equal to or greater than 0.10% and equal to or less than 0.80%

Mn equal to or greater than 1.00% and equal to or less than 1.70%

Cr equal to or greater than 0.10% and equal to or less than 1.50%

Mo equal to or greater than 0.30% and equal to or less than 0.70%

V equal to or greater than 0.005% and equal to or less than 0.12%

Nb equal to or greater than 0.005% and equal to or less than 0.060%

B equal to or greater than 0.0006% and equal to or less than 0.005%

P equal to or less than 0.025%

S equal to or less than 0.010%

N equal to or less than 0.015%

Cu equal to or less than 0.30%

Ni equal to or less than 2.50%

Ti equal to or less than 0.05%

Zr equal to or less than 0.15%

Al equal to or less than 0.01%

Remainder iron and impurities.

10. The cylindrical shell (3) for a Yankee cylinder according to claim 9, wherein said cylindrical shell consists of steel with the following composition by weight:

C equal to or greater than 0.12% and equal to or less than 0.20%

Si equal to or greater than 0.10 and equal to or less than 0.80%

Mn equal to or greater than 1.00% and equal to or less than 1.70%

Cr equal to or greater than 0.10% and equal to or less than 1.50%

Mo equal to or greater than 0.30% and equal to or less than 0.70%

V equal to or greater than 0.005% and equal to or less than 0 12%

Nb equal to or greater than 0.005% and equal to or less than 0.060%

B equal to or greater than 0.0006% and equal to or less than 0.005%

P equal to or less than 0.025%

S equal to or less than 0.010%

N equal to or less than 0.015%

Cu equal to or less than 0.30%

Ni equal to or less than 2.50%

Ti equal to or less than 0.05%

Zr equal to or less than 0.15%

Al equal to or less than 0.01%

Remainder iron and impurities.

11. The cylindrical shell for a steel Yankee according to claim 9, wherein the sum of the percentages by weight of Nb, Ti, V, Zr in the steel is equal to or greater than 0.015%.

12. The cylindrical shell for a steel Yankee according to claim 9, wherein the sum of the percentages by weight of V, Ti, ND, and Al in the steel is equal to greater than 0.02%.

13. The cylindrical shell according to claim 9, wherein the shell has a maximum thickness which is equal to or less than 50 mm thick and the upper yield strength (ReH) measured by ISO 6892-1:2019 of the steel is equal to or greater than 690 MPa and the corresponding tensile strength measured by ISO 6892-1:2019 is equal to or greater than 770 MPa and equal to or less than 940 MPa.

14. The cylindrical shell according to claim 9, wherein the shell is greater than 50 mm thick and equal to or less than 100 mm thick and the yield strength measured by ISO 6892-1:2019 of the steel is equal to or greater than 670 MPa and the corresponding tensile strength measured by ISO 6892-1:2019 is equal to or greater than 770 MPa and equal to or less than 940 MPa.

15. The cylindrical shell according to claim 9, wherein the shell is greater than 100 mm thick and the yield strength measured by ISO 6892-1:2019 of the steel is equal to or greater 630 MPa and the corresponding tensile strength measured by ISO 6892-1:2019 is equal to or greater than 720 MPa to 900 MPa.

* * * * *